United States Patent [19]

Larizza

[11] Patent Number: 4,653,949

[45] Date of Patent: Mar. 31, 1987

[54] WRITING OR DRAFTING INSTRUMENT WITH CAP ACTUATOR

[75] Inventor: Pietro Larizza, Limbiate, Italy

[73] Assignee: Snappy s.r.l., Limiate, Italy

[21] Appl. No.: 668,549

[22] Filed: Nov. 5, 1984

[30] Foreign Application Priority Data

Nov. 22, 1983 [IT] Italy ..... 23623/83[U]

[51] Int. Cl.[4] ..... B43K 7/12; B43K 24/02

[52] U.S. Cl. ..... 401/99; 401/60; 401/98; 401/102; 401/109; 401/243; 401/213

[58] Field of Search ..... 401/98, 99, 102, 108, 401/109, 247, 213, 243, 60; 30/162

[56] References Cited

U.S. PATENT DOCUMENTS

| | | | |
|---|---|---|---|
| 526,427 | 9/1894 | Wirt | 401/109 |
| 1,615,506 | 1/1927 | Felt | 401/247 |
| 1,693,151 | 11/1928 | Mayer | 401/60 |
| 1,734,117 | 11/1929 | Coryell | 401/60 |
| 1,859,775 | 5/1932 | Hyams | 401/98 |
| 4,500,220 | 2/1985 | Hashimoto | 401/102 X |
| 4,518,273 | 5/1985 | Larizza | 401/98 |

FOREIGN PATENT DOCUMENTS

| | | | |
|---|---|---|---|
| 485203 | 12/1917 | France | 401/109 |
| 568454 | 9/1960 | Italy | 401/102 |

*Primary Examiner*—Steven A. Bratlie

*Attorney, Agent, or Firm*—Seidel, Gonda, Goldhammer & Abbott

[57] ABSTRACT

A writing instrument having a main body housing a movable, spring-biased sliding member bearing a writing element. The main body is pivotable about the inturned ends of wires attached to and depending from an overlying cap/actuator. In one pivot position the main body is acted on by the cap to cause the point of the writing element to protrude out of the main body against the urging of a spring. In a second pivot position the writing element is free to recede within the main body under the urging of the spring.

7 Claims, 5 Drawing Figures

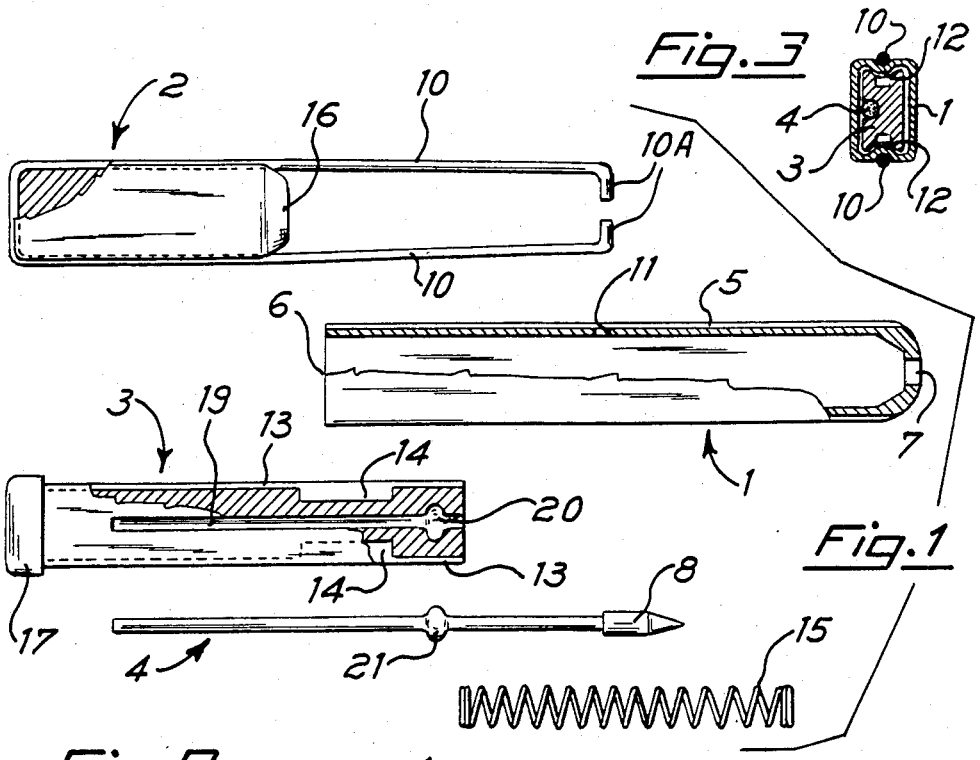
Fig. 3
Fig. 1
2
16
10
10A
10
11
5
6
7
1
3
19
13
14
20
13
14
8
17
4
21
15
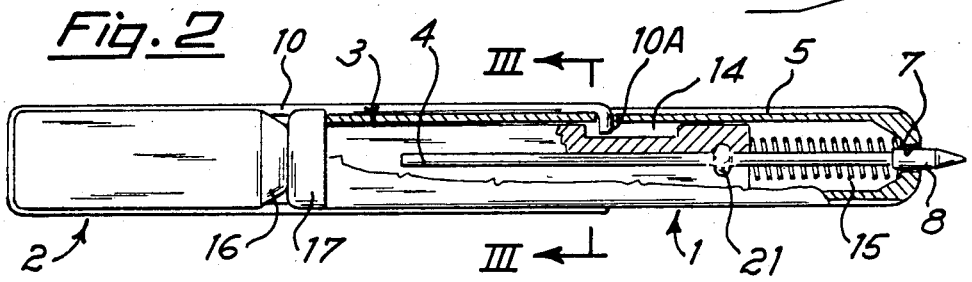
Fig. 2
10
3
4
III
10A
14
5
7
2
16
17
III
1
21
15
8
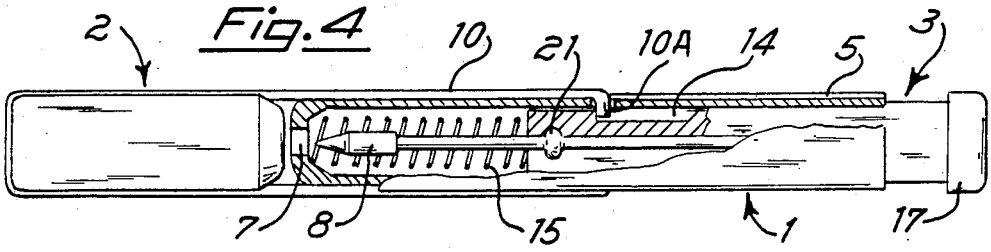
Fig. 4
2
10
21
10A
14
5
3
7
8
15
1
17
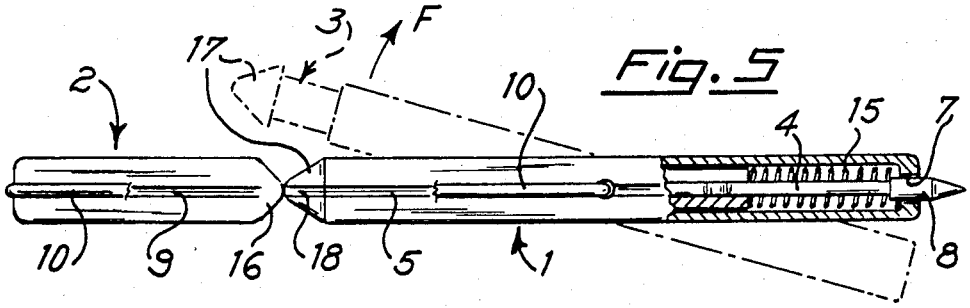
Fig. 5
17
3
F
2
10
4
15
7
10
9
16
18
5
1
8

WRITING OR DRAFTING INSTRUMENT WITH CAP ACTUATOR

SUMMARY OF THE INVENTION

The present invention concerns a writing or drafting instrument, for instance a ball point pen or the like.

BRIEF DESCRIPTION OF THE DRAWINGS

The writing or drafting instrument according to this invention will be described herein in one of the embodiments thereof, which is not intended to limit the scope of the invention, with reference to the attached drawings in which:

FIG. 1 is a view showing the various pieces comprising the instrument according to this invention, separate from each other;

FIG. 2 is a view showing the instrument in its operating condition for writing;

FIG. 3 is a sectional view of the instrument along section line III—III of FIG. 2;

FIG. 4 is a view of the instrument in its closed condition;

FIG. 5 is a side view of the instrument that shows how to take it from its operational condition to its closed condition.

DESCRIPTION OF THE PREFERRED EMBODIMENT

The following description of the instrument according to this invention refers to a particular case of a ball point pen provided with the so called replaceable refill, but it will be understood that the same innovative concept can be applied to other writing instruments as well, even though they are not strictly ball point pens.

Referring now to the attached drawings, the ball point pen according to this invention includes essentially a main body, generally indicated with 1, having connected and associated therewith a member 2 that, in the closed condition of the pen (FIG. 4), can be considered as a cap, but more properly performs as an actuator for a member 3 sliding inside the main body 1, and is adapted to bring the pen into its operating condition (FIG. 2).

The pen according to this invention also includes a refill 4, known per se, and adapted to be contained, in a way that will be further described, in the sliding member 3, so that, due to the displacement of said sliding member caused by member 2, it can be brought to its operative condition, as shown in FIG. 2, or to its nonoperative condition as shown in FIG. 4, when said refill 4 is completely recessed inside the main body 1.

The main body 1 is of a generally flat shape (FIG. 5), and it is provided, at both minor sides thereof, with longitudinal grooves 5 extending approximately along the whole length of said main body. Main body 1 is open at one end indicated with 6, to allow sliding member 3 to be inserted therein, while at the other end it is provided with an opening 7 that allows point 8 of refill 4 to pass through main body 1 and to protrude therefrom.

Similarly, member 2 which is associated and connected to the main body 1, has a flattened shape (FIG. 5) which is also provided with peripheral grooves 9 extending along the whole periphery thereof, except for the area where said member 2 will engage the end of sliding member 3, as will be apparent from the following.

Affixed to member 2 is a means for connecting to main body 1, comprising a metal wire 10 substantially U-shaped and made for instance of resilient steel. Metal wire 10 is securely applied and affixed to member 2 in any known way, and its prongs are extensively longer than member 2, in such a way that the ends 10A of wire 10, which are bent at a 90° angle towards main body 1, can be inserted into openings 11 of the aforesaid body to obtain said connection. When member 2 is separated from main body 1, the prongs of metal wire 10 (FIG. 1) are advantageously slightly convergent towards the ends 10A, in such a way that when metal wire 10 is applied to main body 1, a slight opening of its prongs has to take place in order to allow the ends 10A to enter openings 11. Furthermore, after this insertion, the prongs of metal wire 10 will resiliently snap into grooves 5 of main body 1 and will be securely held inside said grooves so that they can ensure that the ball point pen is maintained in the condition shown in FIG. 2, i.e. in its operative condition. Similarly, when the pen is brought to its nonoperative condition (FIG. 4), the prongs of metal wire 10 will resiliently snap into the other portion of grooves 5 of main body 1 in such a way to ensure stability for this condition as well.

Also sliding member 3 is of a generally flattened shape and, more particularly, both minor sides thereof have a shape complementary to the internal shape of the minor sides of main body 1. In fact, if reference is made in particular to FIG. 3, it can be noted that the internal shape of the minor sides of main body 1 is provided, for the whole area corresponding to outer grooves 5, with an internal rib 12 resulting from the same wall of main body 1 bent inwardly to form grooves 5. Sliding member 3 is correspondingly provided, on both minor sides thereof, with grooves 13 adapted to engage with inner ribs 12 of main body 1 so that a guide means for said sliding element is provided.

Sliding member 3 is provided, on both minor sides thereof, and close to the side where refill 4 protrudes from, with a notch 14 one side of which acts (FIG. 4) as a stop means for sliding member 3 from protruding out of main body 1 when the pen is in its closed condition. In fact, in such condition a spring 15 provided internally of main body 1 between the end thereof where opening 7 is located, and sliding member 3, causes the latter to partially protrude out of main body 1 and consequently makes point 8 of refill 4 recede into main body 1 until one side of the notches 14 of sliding member 3 engages the end 10A of metal wire 10.

In the second operating condition, shown in FIG. 2, point 8 of refill 4 is pushed out by a displacement of sliding member 3 to the right, referring to FIG. 2, said displacement being caused by the engagement of end 16 of member 2 with head 17 provided on sliding member 3. More particularly head 17 has substantially the same outer size as main body 1, being also provided on both minor sides thereof with grooves 18 which are also snap engageable with metal wire 10.

As it can be seen more particularly in FIG. 5, both the end 16 of member 2 and head 17 of sliding member 3 have a substantially triangular shape, in a side view, since they have both a generally prismatic shape with a beveled tip or end edge providing for an easier engagement or disengagement thereof.

Finally, sliding member 3 is provided with a longitudinal groove 19 having an enlarged portion 20 in an intermediate area of its length. Groove 19 and its enlarged portion 20 can accommodate respectively the body of refill 4 and an enlarged portion 21 thereof already known from conventional refills. By its engagement with enlarged portion 20 of groove 19, enlarged portion 21 restrains any longitudinal displacement of refill 4 in such a way that the latter will follow exactly any displacement of sliding member 3.

The use of the pen according to this invention should be clear from the above description, but in any case its main features will be summarized in the following.

Referring in particular to FIG. 5, when finished with using the pen, it is enough for the user to apply a slight pressure over main body 1 in order to cause a rotation (clockwise in FIG. 5) of the same and a corresponding disengagement of head 17 of sliding member 3 from end 16 of member 2, so that, as shown by the dashed line, the sliding member 3 can partially move out of main body 1 under the urging of spring 15 as much as it is allowed by the coaction of the shoulder of groove 14 and the ends 10A of metal wire 10. The rotation of main body 1 is meanwhile further continued all the way to the position of FIG. 4, whereby metal wire 10 is eventually brought into snapping engagement with grooves 5 of main body 1.

It will be apparent that the reverse process to what has just been described brings the pen back to the writing position if the sliding member 3 is slightly lowered.

It should be understood that changes and/or modifications can be made to the writing instrument according to this invention without departing from the spirit and scope thereof.

In particular, the above described structure relates to a ball point pen, but it should be understood that the same novel concept can be extended to similar writing instruments.

What I claim is:

1. A writing instrument comprising an elongate, tubular main body; a slidably movable member bearing a writing member integral therewith housed within said main body and having a head protruding from one end of said main body; an actuator cap adjacent said main body having attached thereto means hinged in a fixed location to said main body for pivotable movement of said main body relative to said actuator cap from a first position where said writing member is maintained within said main body by elastic means acting on said movable member while said actuator cap is disengaged from said head of said movable member to a second position in which the action of the elastic means is overridden by action of the actuator cap on the head of said movable member, the distance between the pivot point on the main body and said actuator cap being such that engagement of said actuator cap with said body body generates a pressure applied to the movable member to cause compression of said elastic means and movement of the movable member into the main body thereby to cause the writing member to extend out of the main body into its operative condition.

2. A writing or drafting instrument according to claim 8 characterized in that said main body and said actuator cap have a substantially flat shape and are connected to each other by means of a metal wire shaped substantially as an elongated U having ends pivotaly engagable inside openings of the main body, on either of the minor sides of the movable member a notch being provided, in a position corresponding to that of said openings, whereby one side of said notch provides a stop counteracting the effect of said elastic means on said movable member.

3. A writing or drafting instrument according to claim 1 characterized in that one end of said cap has a substantially prismatic shape with a beveled edge adapted to engage the correspondingly shaped head provided on said movable member, the distance between the pivot point on the main body and the beveled edge of said cap being such that the engagement of said edge with said head generates a pressure applied to the movable member to cause compression of said elastic means and movement of the movable member into the main body, whereby the writing member is placed in its operative condition.

4. A writing or drafting instrument according to claim 1, characterized in that said movable member, at a substantially central position of its length, is provided with a groove adapted to accomodate the writing member, in particular a refill, and to inhibit any longitudinal movement of the latter.

5. A writing or drafting instrument according to claim 4, characterized in that on refill an enlarged portion is provided, adapted to fit inside a corresponding enlarged portion of groove of sliding member.

6. A writing or drafting instrument according to claim 1, characterized in that said movable member has a substantially flat shape and its minor sides are provided with a groove engageable with rib portions formed on corresponding sides of said main body.

7. A writing or drafting instrument according to claim 3, characterized in that the head of said movable member engageable with the end of said actuator cap has substantially the same shape as said main body and is pushed against the open end thereof by the actuator cap both minor sides of said head being provided with grooves wherein a metal wire is engageable by a snap coupling action.

* * * * *